US009856817B2

(12) United States Patent
Nicosia et al.

(10) Patent No.: US 9,856,817 B2
(45) Date of Patent: Jan. 2, 2018

(54) BOLT-ON CYLINDER KIT AND METHOD FOR INCREASING THE DISPLACEMENT OF AN ENGINE

(71) Applicant: Harley-Davidson Motor Company Group, LLC, Milwaukee, WI (US)

(72) Inventors: Tony Nicosia, Brookfield, WI (US); Brad Bishop, West Bend, WI (US); Mark Dane, Eagle, WI (US)

(73) Assignee: Harley-Davidson Motor Company Group, LLC, Milwaukee, WI (US)

( * ) Notice: Subject to any disclaimer, the term of this patent is extended or adjusted under 35 U.S.C. 154(b) by 113 days.

(21) Appl. No.: 14/674,222

(22) Filed: Mar. 31, 2015

(65) Prior Publication Data

US 2016/0290276 A1 Oct. 6, 2016

(51) Int. Cl.

| | |
|---|---|
| ***F02F 1/06*** | (2006.01) |
| ***F02F 1/00*** | (2006.01) |
| ***F02B 61/02*** | (2006.01) |
| *F02B 75/22* | (2006.01) |
| *F02F 1/08* | (2006.01) |

(52) U.S. Cl.

CPC ..... *F02F 1/004* (2013.01); *F02B 61/02* (2013.01); *F02B 75/22* (2013.01); *F02F 1/00* (2013.01); *F02F 1/08* (2013.01)

(58) Field of Classification Search

CPC ..... F02F 1/00; F02F 1/004
USPC ..... 123/41.69
See application file for complete search history.

(56) References Cited

U.S. PATENT DOCUMENTS

| | | | |
|---|---|---|---|
| 2,279,671 | A | 4/1942 | Ford |
| 5,197,432 | A | 3/1993 | Ballheimer |
| 5,497,693 | A | 3/1996 | Ward |
| 5,566,450 | A | 10/1996 | Rao et al. |

(Continued)

FOREIGN PATENT DOCUMENTS

| | | |
|---|---|---|
| GB | 552049 | 3/1943 |
| GB | 599684 | 3/1948 |

(Continued)

OTHER PUBLICATIONS

Wikipedia, "NIKASIL" (accessed May 28, 2015, dated Jan. 22, 2015) 2 pages.

(Continued)

*Primary Examiner* — Jacob Amick
*Assistant Examiner* — Charles Brauch
(74) *Attorney, Agent, or Firm* — Michael Best & Friedrich LLP

(57) ABSTRACT

A cylinder for a V-twin engine including a body with a first end having a surface configured to mate with a cylinder head, and a second end configured to mate with a crankcase. A sleeve is fixedly secured within the body to define a cylinder bore. The sleeve includes a first portion that extends from the first end of the body to the second end of the body. The first portion of the sleeve has a first wall thickness. The sleeve further includes a second portion that extends out of the second end of the body to be received within a crankcase bore. The second portion has a second wall thickness that is thinner than the first wall thickness. The sleeve is constructed from a chromoly steel alloy material, and the second wall thickness is less than 0.060 inch.

22 Claims, 6 Drawing Sheets

(56) References Cited

U.S. PATENT DOCUMENTS

| | | | | |
|---|---|---|---|---|
| 5,666,725 | A | 9/1997 | Ward | |
| 6,408,803 | B1 † | 6/2002 | Atkins | |
| 6,532,915 | B2 | 3/2003 | Thompson | |
| 6,557,513 | B1 * | 5/2003 | Hill | F02F 1/18 123/193.1 |
| 6,735,863 | B1 | 5/2004 | Hayman | |
| 6,904,885 | B2 | 6/2005 | Osband | |
| 7,234,433 | B2 | 6/2007 | Liebert | |
| 7,255,069 | B2 | 8/2007 | Liebert | |
| 7,258,087 | B1 | 8/2007 | Chrisman et al. | |
| 7,703,423 | B2 † | 4/2010 | Burgess | |
| 7,726,273 | B2 † | 6/2010 | Azevedo | |
| 8,468,694 | B2 | 6/2013 | Moss et al. | |
| 8,714,131 | B2 | 5/2014 | Ostein et al. | |
| 2004/0244758 | A1 | 12/2004 | Weng et al. | |
| 2004/0261971 | A1 * | 12/2004 | Matsumoto | B22D 19/0009 164/98 |
| 2005/0155561 | A1 * | 7/2005 | Atkins | F01P 3/02 123/41.81 |
| 2005/0161187 | A1 * | 7/2005 | Kodama | B22D 19/0009 164/66.1 |
| 2007/0012500 | A1 * | 1/2007 | Brown | B62K 11/06 180/219 |
| 2007/0277771 | A1 * | 12/2007 | Holtan | B22D 19/0009 123/193.2 |
| 2008/0161142 | A1 * | 7/2008 | Shiozaki | F02B 61/02 474/70 |
| 2008/0289598 | A1 | 11/2008 | Hollinger | |
| 2011/0139111 | A1 | 6/2011 | Stephan | |
| 2012/0260881 | A1 * | 10/2012 | Trease | F02F 1/045 123/193.5 |
| 2013/0206124 | A1 | 8/2013 | Quinton et al. | |

FOREIGN PATENT DOCUMENTS

| | | |
|---|---|---|
| JP | 60155665 | 8/1985 |
| JP | 63118357 | 5/1988 |

OTHER PUBLICATIONS

V-Twin Manufacturing, "83 Evolution Big Bore Cylinder Kit," on-line catalog support (accessed May 28, 2015) http://www.vtwinmfg.com/webapp/wcs/stores/servlet/VTwinProd1__10101__10102__3291547__-1 (1 page).

V-Twin 11-1253 "83 Evolution Big Bore Cylinder Kit," on-line parts list (listed as first available Mar. 12, 2015) https://www.amazon.com/V-Twin-11-1253-Evolution-Bore-Cylinder/dp/B00UMDXW50 (4 pages).

Harley-Davidson Motor Company; Screamin' Eagle Pro 4 Inch Bore Cylinder Kits 16555-07, 16556-07; Instructions J04528, pp. 1-4; dated Sep. 18, 2007; <http://www.harley-davidson.com/en_us/media/downloads/service/isheets/-j04528.pdf>. Statement of Relevance attached.

Title: / 6 cylinders in / 5 block (97mm SPIGOT), 9 pages submitted, Publication Date: Sep. 28, 2013, Publisher: http://forum.boxerworks.com, as viewed at http://forum.boxerworks.com/viewtopic.php?t+6986 on Apr. 4, 2017.

Chinn, "Model Engine Tests, Enya VT-240, Engine Review," p. 5, Cylinders (Sep. 1987) Sceptre Flight, http://sceptreflight.net/Model%20Engine%20Tests/Enya%20VT-240.html.

Power Sports Place, "Wiseco Cylinder Sleeves 3209FA", 1 page, undated, available as early as (Sep. 13, 2017) https://www.powersportsplace.com/parts/wis-3209fa/overview/make/harley-davidson.

Wiseco Piston Company, Inc., "110ci Big Bore 'Sleeper Kit' Twin Cam 88 May 1999", 1 page (Oct. 2005) http://www.wiseco.com/pdfs/wisecotwincam88bb.pdf.

"LA Sleeve," 2013 Performance Sleeves Catalog, p. 4.

"Custom Cylinder Sleeves," L.A. Sleeve Co., Inc., Internet Archive of Apr. 3, 2013, p. 1, Retrieved from Internet Sep. 19, 2017 <URL: https://web.archive.org/web/20130403205738/http://www.lasleeve.com/downloads/Custom-Sleeves-Info.pdf)

Title: / 6 cylinders in / 5 block (97mm SPIGOT), 9 pages submitted, Publication Date: Sep. 28, 2013, Publisher: http://forum.boxerworks.com, as viewed at: http://forum.boxerworks.com/viewtopic.php?t=6986 on Apr. 4, 2017.†

* cited by examiner
† cited by third party

BOLT-ON CYLINDER KIT AND METHOD FOR INCREASING THE DISPLACEMENT OF AN ENGINE

BACKGROUND

The present invention relates to engine cylinders for a V-twin engine.

V-twin engines typically include, among other things, two cylinders arranged in a V-configuration. Each cylinder typically includes a body having an exterior surface that may optionally have fins (e.g., for an air-cooled engine). The cylinder also includes opposing ends, whereby a cylinder head is disposed on one of the opposing ends, while the other opposing end is received within the crankcase. A cylinder sleeve within the body defines a cylinder bore configured to slidably receive a piston coupled to a crankshaft of the engine via a connecting rod.

Many owners of V-twin engines, including motorcycle owners, look for ways to increase the power output available from their vehicle. Although some may replace the existing engine with an entirely different, larger engine, this can be extremely costly, labor intensive, problematic and time consuming. Thus, many find that upgrading the existing engine is a more viable option. One way in which power output is increased for an existing V-twin engine entails, among other things, upgrading the engine with a big-bore kit to increase displacement. An exemplary upgrade includes converting existing 96 $in^3$ and 103 $in^3$ Harley-Davidson Twin Cam engines to 110 $in^3$ displacement engines by providing replacement cylinders having cylinder bore diameters of 4 inches.

Along with the cylinder bore increase, the outer diameter portion of the sleeve that fits into the crankcase has a similar increase in size. This is because the cylinder sleeve wall thickness of the new cylinder is typically about the same as that of the original cylinder that is removed (i.e., typical wall thickness may be about 0.090 inch for cast iron sleeves) to maintain the requisite sleeve strength. Thus, when replacing original cylinders with larger bore replacement cylinders as previously mentioned, it is also necessary to increase the diameter of the corresponding crankcase bores to which the cylinders are fitted. Increasing the size of the crankcase bores entails removing the crankcase from the vehicle, splitting apart the crankcase halves and machining the crankcase bores to allow fitting of the larger bore cylinders. Although not as involved as an entire engine replacement in some respects, this process is also very labor intensive and time consuming.

SUMMARY

The present invention provides, in one aspect, a cylinder for a V-twin engine. The cylinder includes a body with a first end having a surface configured to mate with a cylinder head, and a second end configured to mate with a crankcase. A sleeve is fixedly secured within the body to define a cylinder bore. The sleeve includes a first portion that extends from the first end of the body to the second end of the body. The first portion of the sleeve has a first wall thickness. The sleeve further includes a second portion that extends out of the second end of the body to be received within a crankcase bore. The second portion has a second wall thickness that is thinner than the first wall thickness. The sleeve is constructed from a chromoly steel alloy material, and the second wall thickness is less than 0.060 inch.

The present invention provides, in another aspect, a cylinder for a V-twin engine. The cylinder includes a body with a first end having a surface configured to mate with a cylinder head, and a second end configured to mate with a crankcase. A sleeve is fixedly secured within the body to define a cylinder bore. The sleeve includes a first portion that extends from the first end of the body to the second end of the body. The first portion of the sleeve has a first wall thickness. The sleeve further includes a second portion that extends out of the second end of the body to be received within a crankcase bore. The second portion has a second wall thickness that is thinner than the first wall thickness. The second portion has an outer diameter of about 4.068 inches, and the second wall thickness is less than 0.060 inch.

The present invention provides, in another aspect, a method of retrofitting a V-twin engine for increasing displacement. The V-twin engine is provided with a pair of cylinders, each of the pair of cylinders has a first cylinder bore diameter that provides the V-twin engine with a first displacement. Each of the pair of cylinders is dismounted from a crankcase of the V-twin engine. A pair of big-bore replacement cylinders is provided, each having a second cylinder bore diameter larger than the first cylinder bore diameter to provide the V-twin engine with a second displacement greater than the first displacement. A spigot portion of each of the pair of replacement cylinders is aligned with a respective bore of the crankcase. The spigot portion of each of the pair of replacement cylinders is inserted into the respective bore of the crankcase. The pair of replacement cylinders are secured to the crankcase without enlarging either bore of the crankcase.

Other features and aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
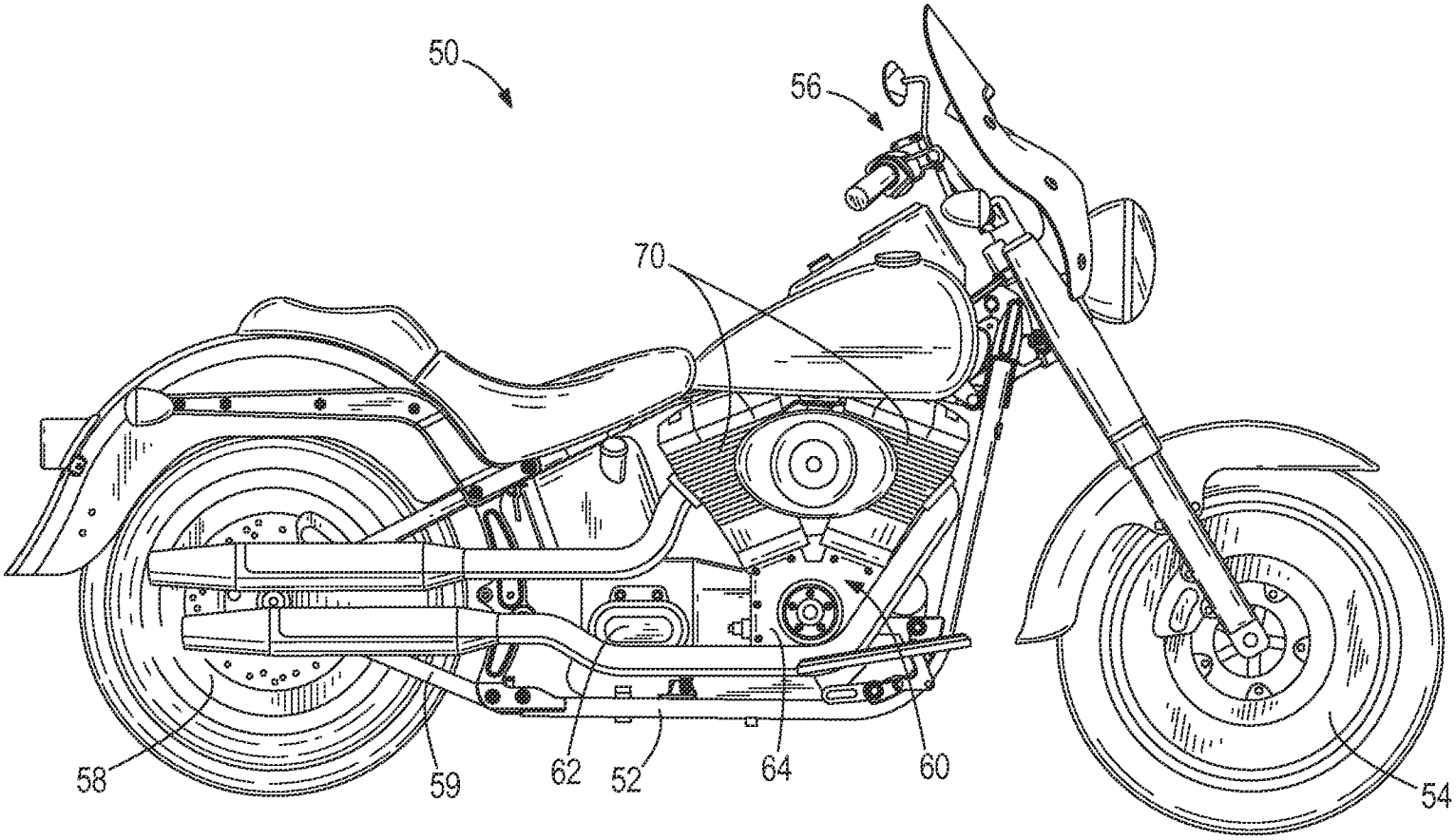
FIG. 1 is a side view of a motorcycle according to one embodiment of the invention.

FIG. 1 illustrates a motorcycle 50. Although illustrated as a touring motorcycle 50, aspects of the invention may be applicable to other types of motorcycles (i.e., standard, cruiser, sport bike, sport touring, dual-sport, etc.). The motorcycle 50 includes a frame 52, a front wheel 54 coupled to the frame 52 through a steering assembly 56, and a rear wheel 58 coupled to the frame 52 through a swing arm assembly 59. The motorcycle 50 includes an engine 60 coupled to the frame 52 and operatively coupled to the rear wheel 58 through a transmission 62. As described below, the engine 60 can be a factory original engine that is modified to increase displacement in accordance with the structures and methods disclosed herein.

Figure 2:
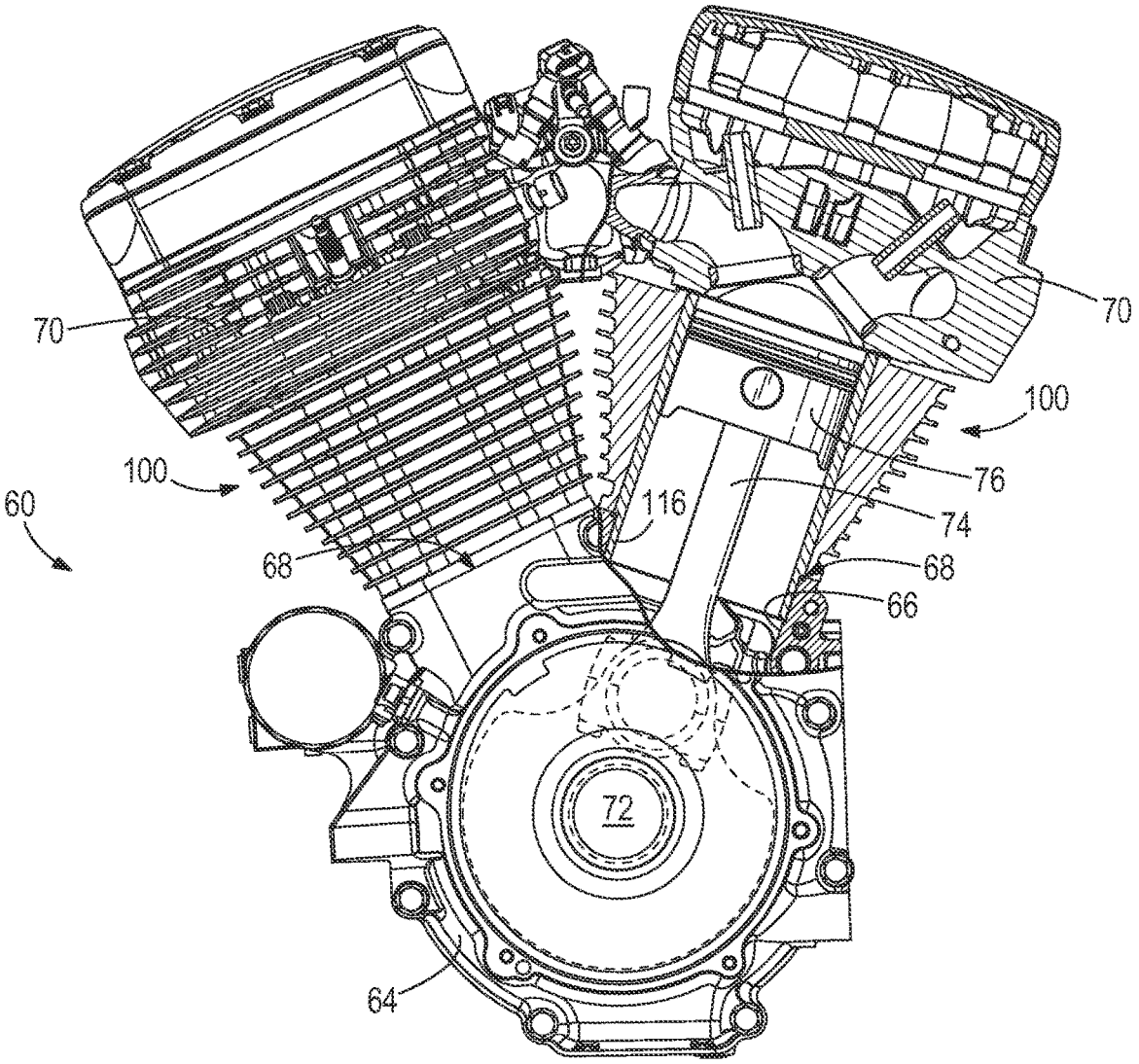
FIG. 2 is a cross-sectional view of a V-twin engine of the motorcycle of FIG. 1. The engine is in an original, conventional configuration.

Illustrated separate from the motorcycle 50 in FIG. 2, the engine 60 includes a pair of cylinders 100 (FIG. 3) oriented in a V-configuration and coupled to a crankcase 64. On one end, a bottom end, each cylinder 100 is positioned in a crankcase bore 66 extending through a crankcase outer surface 68 such that a crankshaft 72 positioned in the crankcase 64 can be coupled to a piston 76 within each of the engine cylinders 100 via a corresponding connecting rod 74. On the other end, a top end, the cylinder 100 receives a cylinder head 70.

Figure 3:
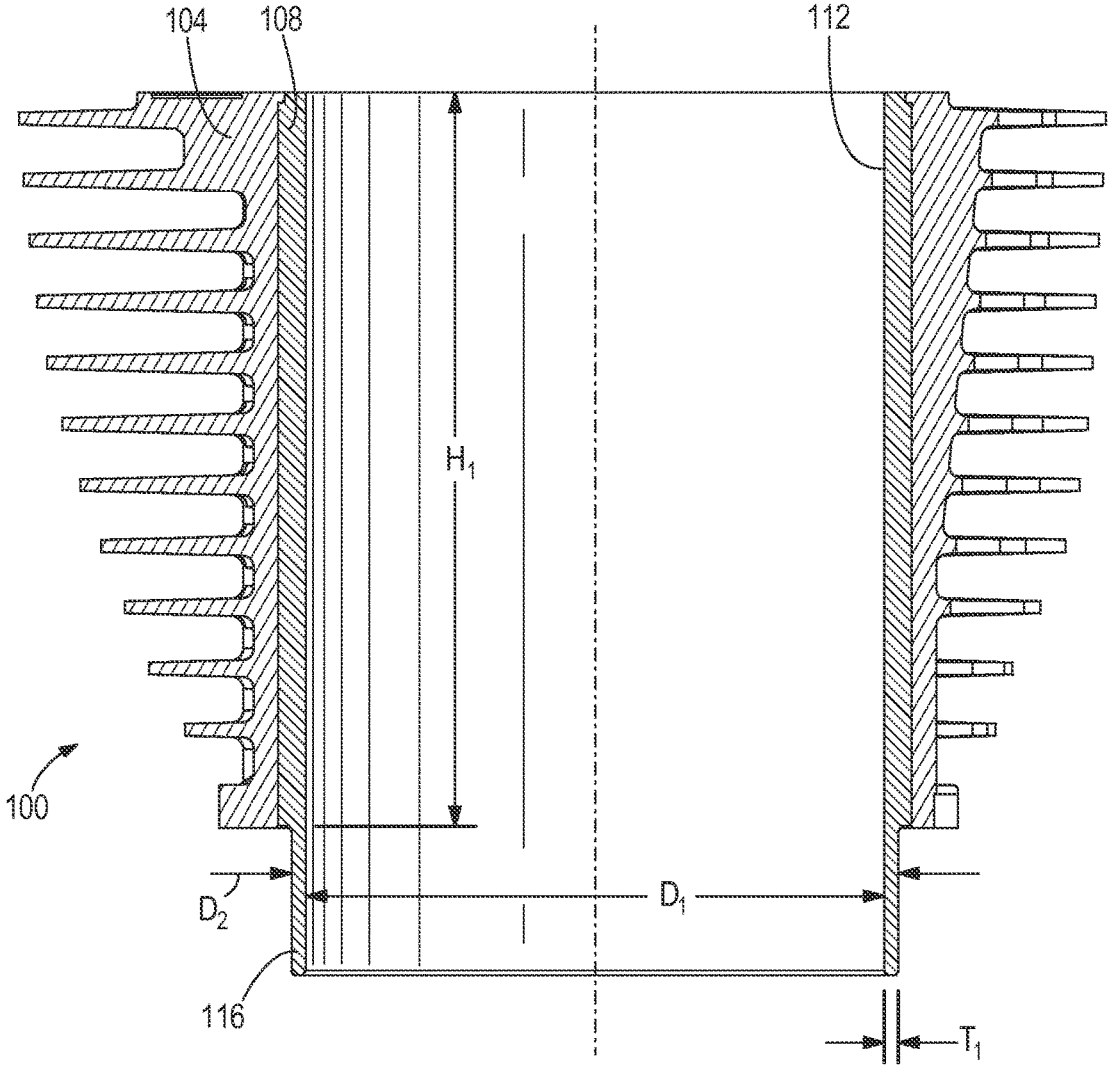
FIG. 3 PRIOR ART
FIG. 3 is a cross-sectional view of one cylinder of the engine of FIG. 2.

Each of the cylinders 100, as shown in FIG. 3, includes a body 104 and a cylinder liner 108. During construction of the cylinder 100, the body 104 is formed by a casting process around the liner 108. Thus, the cylinder liner 108 is fixedly secured within the body 104. The liner 108 defines a cylinder bore 112 and a spigot 116. The spigot 116, which extends out of the body 104, is configured to be received by the crankcase bore 66. The liner 108 and the spigot 116 share the same inner diameter $D_1$. However, the liner 108 and the spigot 116 have different outer diameters, such that the spigot 116 has an outer diameter of $D_2$, and the liner 108 has an outer diameter greater than the spigot outer diameter $D_2$ above the spigot 116. The difference between the inner diameter $D_1$ and the outer diameter $D_2$ of the spigot 116 defines a wall thickness $T_1$ of the spigot 116. The outer diameter $D_2$ of the spigot 116 is designed to have a clearance (e.g., 0.025 inch) between the crankcase bore 66 and the spigot 116 to ensure a slip fit between the components.

The cylinder liner 108 of the factory original cylinder 100 may be constructed of cast iron. In one such example of an existing Harley-Davidson Twin Cam engine, the cylinder liner 108 is cast iron and provided with a spigot wall thickness $T_1$ of 0.090 inch and an inner diameter $D_1$ of 3.875 inches. Although durable, the brittle nature of cast iron results in the inability to machine or re-sleeve the cylinder 100 as the spigot 116 will not have the appropriate design characteristics required to achieve a reliable and robust design if the outer diameter $D_2$ is limited to the size of the existing bore 66. Due to the practical limitations of ordinary cylinder sleeving material, it is common that any big-bore replacement cylinders include a wall thickness equal to or greater than the original cylinder spigot wall thickness $T_1$, which necessitates increasing the size of the crankcase bores 66. In certain exemplary engines, such as Harley-Davidson Twin Cam engines, the crankcase bores 64 have a diameter of about 4.080 inches, which provides a diametric clearance, for example 0.025 inch, with the outer diameter $D_2$ of the spigot 116 of the factory original cylinders 100. However, as previously mentioned, it is necessary to enlarge the crankcase bores 66 when retro-fitting the engine 60 with a big-bore kit.

Figure 4:
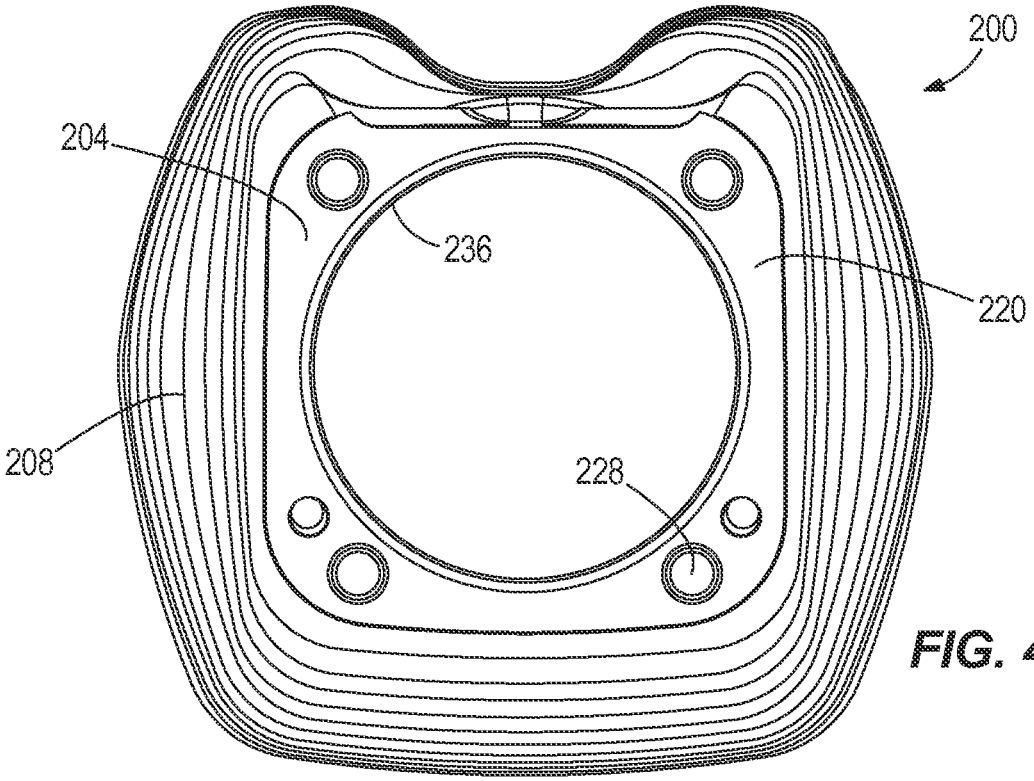
FIG. 4 is a bottom view of an engine cylinder according to one embodiment of the present invention.
Figure 5:
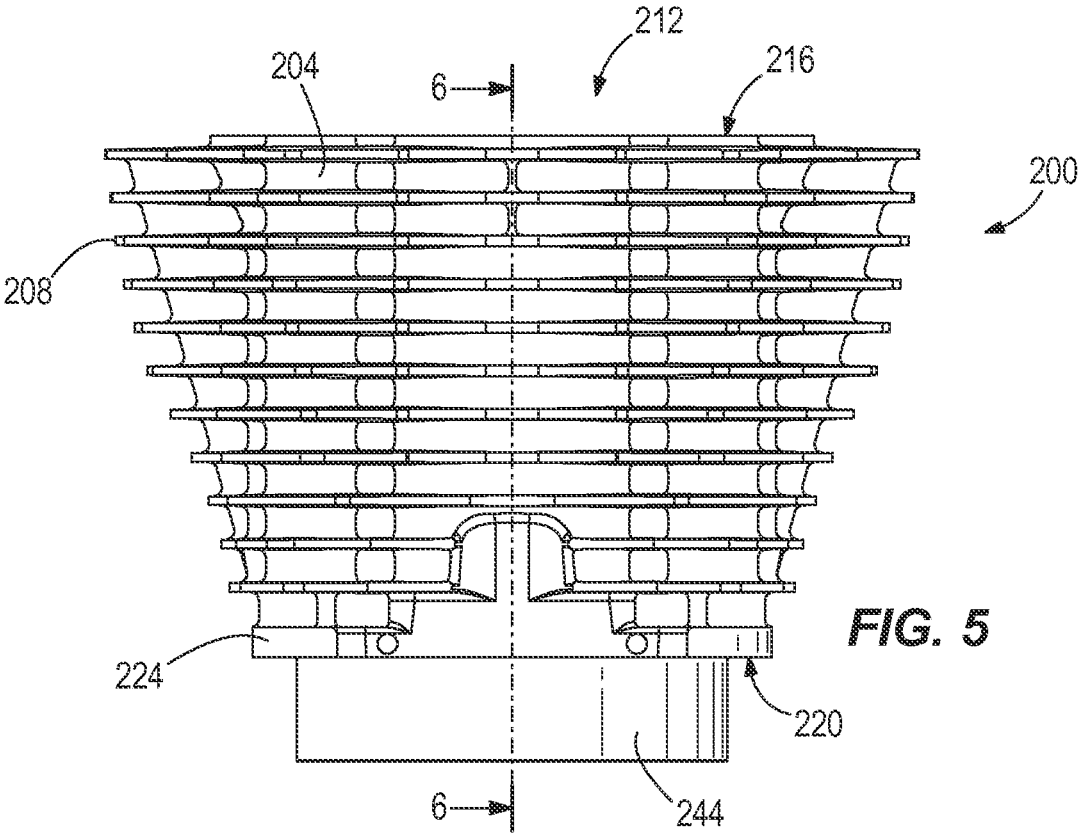
FIG. 5 is a side view of the engine cylinder of FIG. 4.
Figure 6:
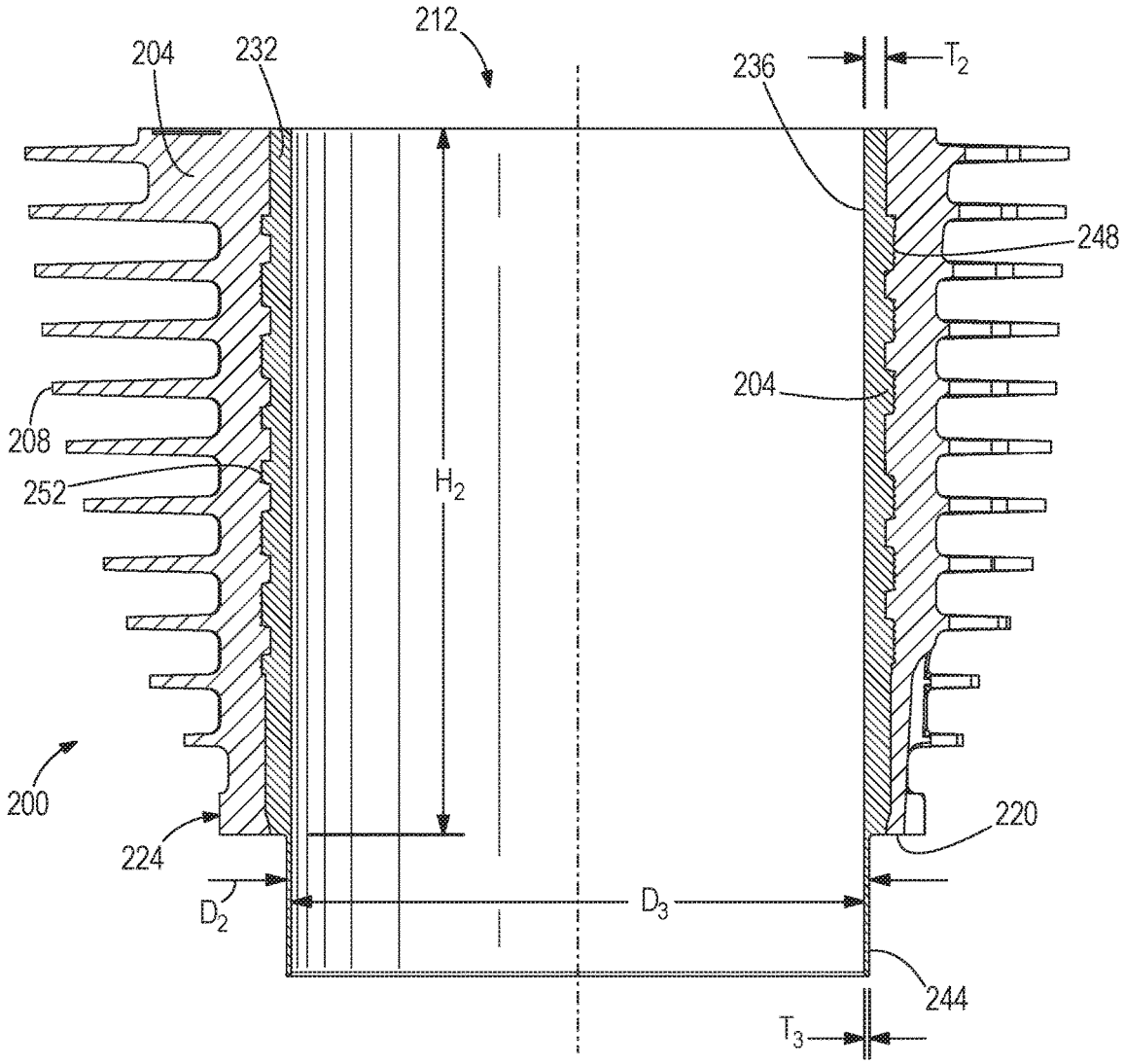
FIG. 6 is a cross-sectional view of the engine cylinder taken along line 6-6 of FIG. 5.

Shown in FIGS. 4-6 is a big-bore cylinder 200 that increases displacement of the engine 60 and that can easily be retrofitted to the crankcase 64 of the engine 60 originally provided with the cylinders 100 of FIG. 3. Switching to the cylinders 200 increases the displacement of the engine 60 in a simple bolt-on process that eliminates the current labor intensive process described above. In a particular exemplary construction, a pair of the big-bore cylinders 200 convert either one of an existing 96 $in^3$ Harley-Davidson Twin Cam engine having cylinder bore diameters of 3.750 inches and an existing 103 $in^3$ Harley-Davidson Twin Cam engine having cylinder bore diameters of 3.875 inches to have a displacement of 110 $in^3$ by increasing cylinder bore diameters to about 4.000 inches. As described below, the cylinders 200 are designed such that they fit into the existing bores 66 of the crankcase 64 such that the engine 60 can be converted to a larger displacement without having to remove, disassemble, or machine the crankcase 64.

Each big-bore cylinder 200 includes a body 204 having a finned exterior 208 configured to increase efficiency of heat transfer of the air-cooled engine. As previously mentioned, the existence of the finned exterior 208 and the particular engine class (i.e., air-cooled) merely represent one exemplary embodiment. As such, it will be understood that, in other constructions, the cylinder 200 may be designed for a liquid-cooled engine and may or may not include a finned exterior.

Additionally, the body 204 includes a first end 212 with a surface 216 configured to mate with a cylinder head 70' which can be a modified version of the cylinder head 70 of the original engine 60 of FIG. 2. The body 204 further includes a second end 220 with a flange 224 providing a surface configured to abut the crankcase 64. The distance between the first end 212 and the second end 220 define a height $H_2$ of the cylinder 200 which, in this case, is the same as a height $H_1$ of the cylinder 100. Furthermore, extending through the body 204 from the surface 216 are a plurality of mounting holes 228 (e.g., four symmetrically arranged mounting holes). Each of the mounting holes 228 is configured to receive a fastener (not shown) to removably couple the cylinder 200 to the crankcase 64.

Figure 7:
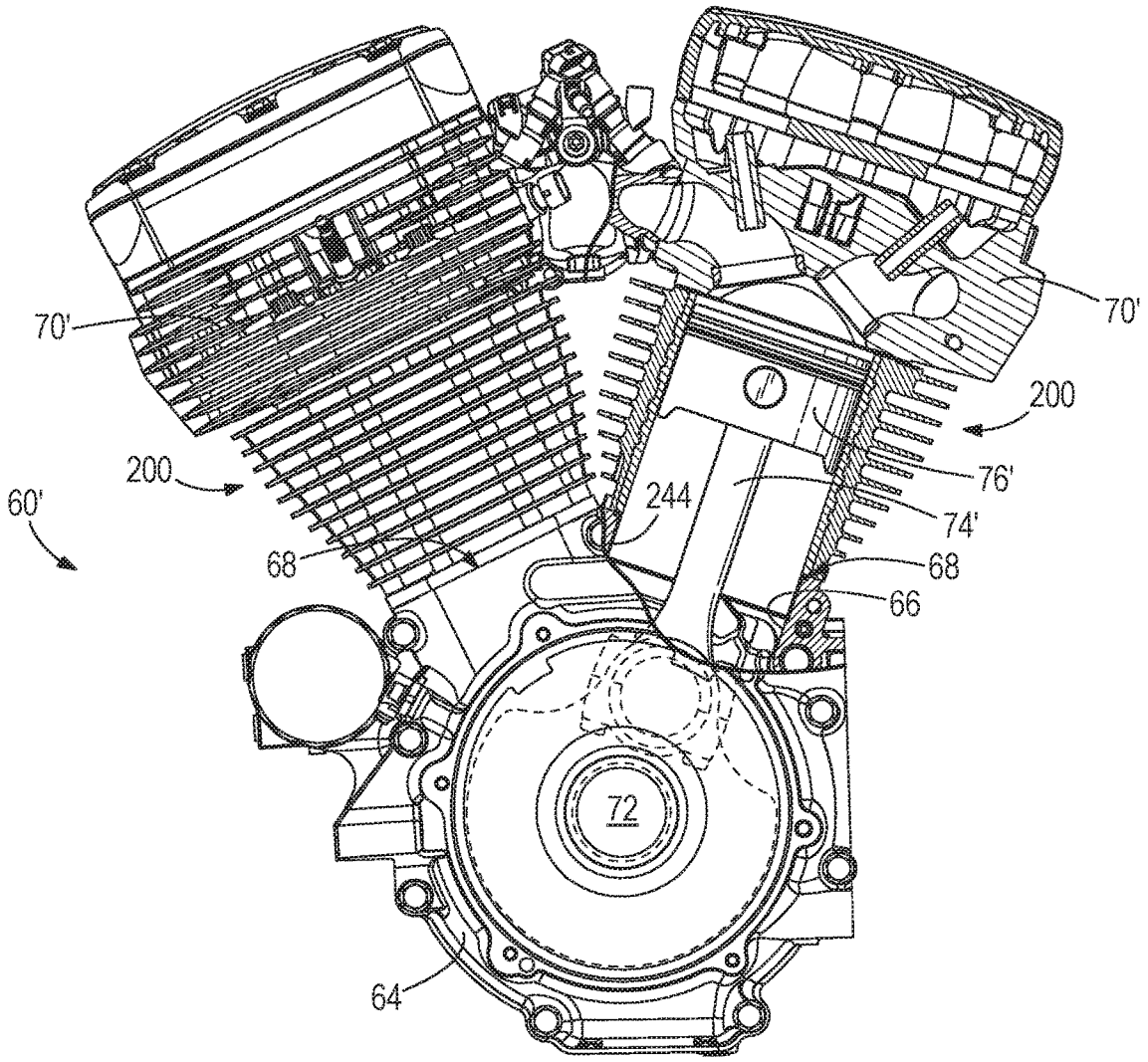
FIG. 7 is a cross-sectional view of the V-twin engine of FIG. 2 after being converted with a pair of the engine cylinders of FIGS. 4-6.

The cylinder 200 includes a sleeve 232 fixedly secured within the body 204 to define a cylinder bore 236. The sleeve 232 may be fixedly secured by a casting process whereby the body 204 is formed onto the exterior of the sleeve 232. The sleeve 232 has a main portion 240 and a second portion or spigot 244. The main portion 240 extends from the first end 212 to the second end 220 within the body 204, and the spigot 244 extends out of the body 204 and protrudes past the second end 220. When the cylinder 200 and the crankcase 64 are coupled, the crankcase bore 66 receives the spigot 244, as shown in FIG. 7.

In some constructions, the sleeve 232 is manufactured from tubing. The tubing can be cut to length, and machined in a subtractive process to form the spigot 244. As depicted in FIG. 6, the main portion 240 has a wall thickness $T_2$, and the spigot 244 has a spigot wall thickness $T_3$ different from the wall thickness $T_2$ of the main portion 240. In the illustrated construction, the spigot wall thickness $T_3$ is thinner than the wall thickness $T_2$ of the main portion 240. In order to provide a large bore size with a limited outside dimension, the spigot wall thickness $T_3$ may be less than 0.060 inch. The spigot wall thickness $T_3$ may be greater than 0.025 inch, and in some constructions, greater than 0.030 inch. In some constructions, the spigot wall thickness $T_3$ is less than 0.050 inch, and furthermore, the spigot wall thickness $T_3$ may be less than 0.040 inch. In some embodiments, the wall thickness $T_3$ is about 0.034 inch (e.g., 0.033 inch to 0.035 inch). In a construction where the outer diameter $D_2$ of the spigot portion 244 is about 4.068 inches (e.g., 4.067 inches to 4.069 inches), the thin wall thickness $T_3$ allows a cylinder bore diameter $D_3$ that is greater than 3.948 inches. In some constructions, the bore diameter $D_3$ is about 4.000 inches (e.g., 3.9997 inches to 4.0005 inches). Whether the outer diameter D2 of the spigot portion 244 is at, above, or below 4.068 inches, diametric clearance may be provided between the spigot portion 244 and the crankcase bores 66 to enable a slip fit of the spigot portion 244 into the crankcase bore 66. For example, the nominal diametric clearance is 0.012 inch when the outer diameter $D_2$ of the spigot portion 244 is 4.068 inches and each of the crankcase bores 66 has a diameter of 4.080 inches.

The sleeve 232 is constructed from a material that is substantially less brittle than cast iron. For example, the sleeve 232 can be constructed of a type of chromoly steel alloy material. In some constructions, the sleeve 232 is constructed from SAE grade 4140 steel.

Additionally, the radially exterior surface of the main portion 240 of the sleeve 232 includes an intersecting helical pattern having a helical coarse rib 248 and a helical fine rib 252, each protruded radially outward as shown in FIG. 6. The helical ribs 248, 252 may be provided in the form of two different sized screw threads. The axial component of the helix is opposite for the two helical ribs 248, 252 such that one of the helical ribs 248, 252 is provided in a right hand rotation direction (i.e., clockwise), and the other of the helical ribs 248, 252 is provided in a left hand rotation direction (i.e., counterclockwise), which provides the intersecting pattern. Each of the helical ribs 248, 252 extends a majority of the height $H_2$ of the main portion 240. The intersecting helical pattern is designed to securely lock the body 204 and the sleeve 232 together against separation or movement, particularly from rotational forces caused by twisting or vibration.

The design of the cylinder 200 enables it to be used in place of one of the factory original cylinder 100 to increase the displacement of the engine 60 without removal of the crankcase 64 and modification to the crankcase bores 66. The process entails a simple removal procedure of the cylinders 100 and replacement procedure with the corresponding big-bore cylinders 200. FIG. 7 illustrates an engine 60' that results from converting the engine 60 of FIG. 2 with the installation of the cylinders 200 after removal of the cylinders 100. During installation, the spigot portion 244 of each cylinder 200 is aligned with and inserted into the respective crankcase bore 66, which is unmodified and retains its original size which was provided when accommodating the original, smaller-bore cylinder 100. The installation of the cylinders 200 may be performed as part of a kit of corresponding parts matched with the cylinders 200. For example, converting the engine 60 to the modified engine 60' may include installation of new pistons 76'(and corresponding piston rings) in addition to the cylinder heads 70'. New connecting rods 74' may optionally be provided and installed as well, although alternately, the factory original connecting rods 74 may be re-utilized when upsizing the displacement. The engine cylinder 200 may be removably secured to the crankcase 64 with suitable fasteners. Also provided is the cylinder head 70' for each cylinder 200.

The embodiment described above and illustrated in the figures are presented by way of example only and are not intended as a limitation upon the concepts and principles of the present invention. As such, it will be appreciated that various changes in the elements and their configuration and arrangement are possible without departing from the spirit and scope of the present invention.

What is claimed is:

1. A cylinder for a V-twin engine, the cylinder comprising:

a body including a first end having a surface configured to mate with a cylinder head, and a second end configured to mate with a crankcase; and a sleeve fixedly secured within the body to define a cylinder bore;

wherein the sleeve includes a first portion that extends from the first end of the body to the second end of the body, the first portion of the sleeve having a first wall thickness;

wherein the sleeve further includes a second portion that extends out of the second end of the body to be received within a crankcase bore, the second portion having a second wall thickness that is thinner than the first wall thickness;

wherein the sleeve is constructed from a chromoly steel alloy material; and wherein the second wall thickness is less than 0.050 inch.

2. The cylinder of claim 1, wherein the body includes an exterior surface having a plurality of fins.

3. The cylinder of claim 1, wherein the body is solid, having no internal voids or cooling jackets for cooling liquid.

4. The cylinder of claim 1, wherein the body further includes a flange proximate to the second end, the flange defining a surface configured to abut the crankcase, and a plurality of mounting holes extending from the surface through the body.

5. The cylinder of claim 1, wherein the cylinder is formed by casting the body around an exterior of the first portion of the sleeve.

6. The cylinder of claim 1, wherein the sleeve is manufactured from a section of tubing and the second portion is formed by machining an outer diameter of the tubing section.

7. The cylinder of claim 6, wherein the outer diameter of the second portion is about 4.068 inches.

8. The cylinder of claim 1, wherein the sleeve is constructed from SAE grade 4140 steel.

9. The cylinder of claim 1, wherein the second wall thickness is greater than 0.025 inch.

10. The cylinder of claim 1, wherein the second wall thickness is less than 0.040 inch.

11. The cylinder of claim 1, wherein the second wall thickness is between 0.033 inch and 0.035 inch.

12. A cylinder for a V-twin engine, the cylinder comprising:

a body including a first end having a surface configured to mate with a cylinder head, and a second end configured to mate with a crankcase; and a sleeve fixedly secured within the body to define a cylinder bore;

wherein the sleeve includes a first portion that extends from the first end of the body to the second end of the body; the first portion of the sleeve having a first wall thickness;

wherein the sleeve further includes a second portion that extends out of the second end of the body to be received within a crankcase bore, the second portion having a second wall thickness that is thinner than the first wall thickness;

wherein the second wall thickness is greater than 0.025 inch and less than 0.040 inch; and wherein the sleeve is constructed from SAE grade 4140 steel.

13. The cylinder of claim 12, wherein the body includes an exterior surface having a plurality of fins.

14. The cylinder of claim 12, wherein the body is solid, having no internal voids or cooling jackets for cooling liquid.

15. The cylinder of claim 12, wherein the body further includes a flange proximate to the second end, the flange defining a surface configured to abut the crankcase, and a plurality of mounting holes extending from the surface through the body.

16. The cylinder of claim 12, wherein the cylinder is formed by casting the body around an exterior of the first portion of the sleeve.

17. The cylinder of claim 12, wherein the sleeve is manufactured from a section of tubing that is machined to achieve the outer diameter of the second portion.

18. The cylinder of claim 12, wherein a diameter of the cylinder bore is greater than 3.948 inches.

19. The cylinder of claim 12, wherein a diameter of the cylinder bore is about 4.000 inches.

20. The cylinder of claim 12, wherein the second wall thickness is greater than 0.030 inch.

21. The cylinder of claim 12, wherein the second wall thickness is between 0.033 inch and 0.035 inch.

22. The cylinder of claim 12, wherein the cylinder bore has a diameter of about 4.000 inches.

* * * * *